US005983518A

United States Patent [19]

Ellenburg

[11] Patent Number: 5,983,518

[45] Date of Patent: Nov. 16, 1999

[54] GOLF GLOVE DRYING ATTACHMENT FOR A GOLF CART OR A GOLF BAG

[76] Inventor: Jeffrey S. Ellenburg, 128 Marion La., Apt. 2, Cocoa Beach, Fla. 32931

[21] Appl. No.: 09/187,064

[22] Filed: Nov. 6, 1998

[51] Int. Cl.[6] ..... F26B 25/00

[52] U.S. Cl. ..... 34/106; 34/104; 34/239

[58] Field of Search ..... 34/239, 103, 104, 34/105, 106

[56] References Cited

U.S. PATENT DOCUMENTS

| | | | |
|---|---|---|---|
| D. 193,408 | 8/1962 | Goldman . | |
| 2,783,925 | 3/1957 | Ross . | |
| 4,689,897 | 9/1987 | Marsalona | 34/103 |
| 4,991,756 | 2/1991 | Benjamin . | |
| 5,117,565 | 6/1992 | Willenbacher, Jr. . | |
| 5,125,169 | 6/1992 | Bader . | |
| 5,177,881 | 1/1993 | Moore . | |
| 5,406,717 | 4/1995 | Dofka . | |
| 5,570,515 | 11/1996 | Schulte | 34/104 |
| 5,604,993 | 2/1997 | Auckerman . | |

FOREIGN PATENT DOCUMENTS

| | | |
|---|---|---|
| 139683 | 12/1948 | Australia . |
| 2740652 | 3/1979 | Germany . |
| 2275326 | 8/1994 | United Kingdom . |

*Primary Examiner*—Henry Bennett
*Assistant Examiner*—Pamela A. Wilson
*Attorney, Agent, or Firm*—Richard C. Litman

[57] ABSTRACT

A golf glove drying attachment for a golf cart or a golf bag, intended to improve air circulation through the glove while the user is on the golf course. The glove drying attachment includes a slightly tapered shell for holding the glove, and a clamp for attaching to a golf cart. As the golf cart is driven, wind from the golf cart dries the glove. Alternatively, the shell may include a battery powered fan, and attach to a golf bag.

8 Claims, 2 Drawing Sheets

GOLF GLOVE DRYING ATTACHMENT FOR A GOLF CART OR A GOLF BAG

BACKGROUND OF THE INVENTION

1. Field of the Invention

The present invention relates to a golf glove drying apparatus. Specifically, the invention is a shell over which the golf glove fits, and which is clamped to the roof support beam of a golf cart so that the glove will dry due to wind as the golf cart is driven. Alternatively, the shell may include a fan, and attach to the top of a golf bag.

2. Description of the Related Art

Several prior inventors have proposed various inventions for drying gloves. Several include hand-shaped frames to hold a glove in a movable position, with some including movable fingers. Others include mechanical drying means such as fans or heaters. Some provide a means of attachment for a convenient location. No other invention within the knowledge of the present inventor, however, has proposed a golf glove dryer with the advantages of means for increasing airflow combined with convenient use on a golf course.

Several other inventors have proposed hand-shaped glove supports. For example, U.S. Pat. No. Des. 193,408, issued to Percy Goldman on Aug. 14, 1962, shows a glove drying apparatus having a hand-shaped frame and a hook-shaped hanger. Second, U.S. Pat. No. 2,783,925, issued to Alexander Ross on Mar. 5, 1957, describes a glove drier having an open frame supporting the palm portion and the four fingers, and a movable thumb portion. The drier has a hook for hanging the glove and drier. Third, U.S. Pat. No. 5,125,169, issued to Michael F. Bader on Jun. 30, 1992, describes a glove drying apparatus having fingers which are angularly movable with respect to each other. The apparatus is placed inside a glove, and the fingers are spread apart until the glove is in its natural position. Lastly, Australian Pat. No. 139,683, published on Dec. 23, 1948, describes a glove form having a hollow, perforated shell. The form is intended to facilitate washing and rinsing the glove.

Some inventors included various mechanical drying means in their glove drying apparatus. For example, U.S. Pat. No. 5,117,565, issued to Thomas H. Willenbacher, Jr. on Jun. 2, 1992, describes a glove drying apparatus having a wire mesh hollow body and a support clip. The invention may include an air conduit attaching at one end to an air duct, and at the other end to the glove drying apparatus. A second example, U.S. Pat. No. 5,570,515, issued to Dietmar Schulte on Nov. 5, 1996, describes a handwear and footwear drying device. The device has a battery-powered motor-driven fan directing air into a Y-shaped divider and into the items to be dried. Third, U.S. Pat. No. 5,604,993, issued to Irmgard G. Auckerman on Feb. 25, 1997, describes a glove drying device having a perforated hollow drying form in the shape of a glove, and a heater. Lastly, German Pat. No. 2,740,652, published on Mar. 22, 1979, describes a clothes dryer having a table with parallel ribs, with a fan underneath the table. None of these inventions are suitable for use on a golf course.

U.S. Pat. No. 4,991,756, issued to John R. Benjamin on Feb. 12, 1991, describes a glove and mitten dryer having a cylindrical frame having diamond shaped ventilation holes.

At least one other inventor has proposed attaching a golf glove drying apparatus to a golf bag. U.S. Pat. No. 5,177,881, issued to Joseph A. Moore on Jan. 12, 1993, describes a golf glove drying apparatus attaching to a golf bag. The glove drying apparatus has a clip at one end, a strap depending from the clip, a plate for displaying the name of the golfer, event, or golf course, a second strap depending from the plate, and one component of a hook and loop fastener on the second strap. The hook and loop fastener mates with the corresponding hook and loop fastener on a golf glove.

U.S. Pat. No. 5,406,717, issued to Charline M. Dofka on Apr. 18, 1995, describes a drying rack for utility gloves. The drying rack includes a drain basin, a pair of removable, telescoping support rods, and a pair of spread ring disks mounted on the support rods.

U.K. Pat. Appl. No. 2,275,326, published on Aug. 24, 1994, describes a glove drying stand having a pair of interlocking perpendicular plates forming a glove support, sitting on a tray.

None of the above inventions and patents, taken either singularly or in combination, is seen to describe the instant. invention as claimed. Thus a golf glove drying attachment for a golf cart or a golf bag solving the aforementioned problems is desired.

SUMMARY OF THE INVENTION

Golfers commonly wear gloves both for increased comfort and for an improved grip on the golf club. However, wearing gloves causes the wearer to sweat. Glove manufacturers put ventilation holes in their gloves to minimize sweating, but it is impossible to eliminate the problem. When a golfer sweats, the sweat causes the glove to slide away from the proper position during a swing, resulting in a bad swing. Additionally, moisture will shorten the usable life of the glove. Carrying extra gloves results in added expense. Therefore, it is desirable to quickly dry a glove while on the golf course, allowing re-use of that glove during the same game.

The invention is a glove drying apparatus with a first embodiment attaching to the roof support beam of a golf cart, arid a second embodiment attaching to a golf bag, and having a fan for drying the glove.

The invention includes a hollow shell having approximately the same configuration as the wrist portion of a glove. The shell's first end attaches to a clamp or clip, and the second end fits within the glove. The second end of the shell is open to provide for air flow into the glove. A typical golf glove has a hook and. loop closure at the wrist portion, which can be secured around this tapered shell. The shell is slightly tapered, so that the second end has a larger cross section than the first end when viewed from one end. This taper ensures that the glove does not slide off the shell.

The first embodiment of the invention relies on wind caused by the movement of a golf cart to dry the glove. This embodiment has an open first end. The first end includes a clamp for attaching to the roof support of a golf cart. When so attached, the glove will be horizontal, and the open front end of the glove dryer will point towards the front of the golf cart. When the golf cart is driven forward, air will thereby flow into the glove, speeding the evaporation of sweat.

The second embodiment attaches to a golf bag. This embodiment has a fan within the first end, drawing air from a group of air holes around the first end, and pushing it into the glove. The first end is attached to a clip which clips to the top lip of a golf bag.

Accordingly, it is a principal object of the invention to provide a golf glove dryer which is usable on a golf course during play.

It is another object of the invention to provide a golf glove dryer which uses the wind created by driving a golf cart to dry a golf glove.

It is a further object of the invention to provide a golf glove dryer attaching to a golf bag.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a golf glove drying apparatus. The first embodiment of the invention attaches to a golf cart, relying on wind to dry the glove. The second embodiment clips to a golf bag, relying on a fan to dry the glove.

Figure 2:
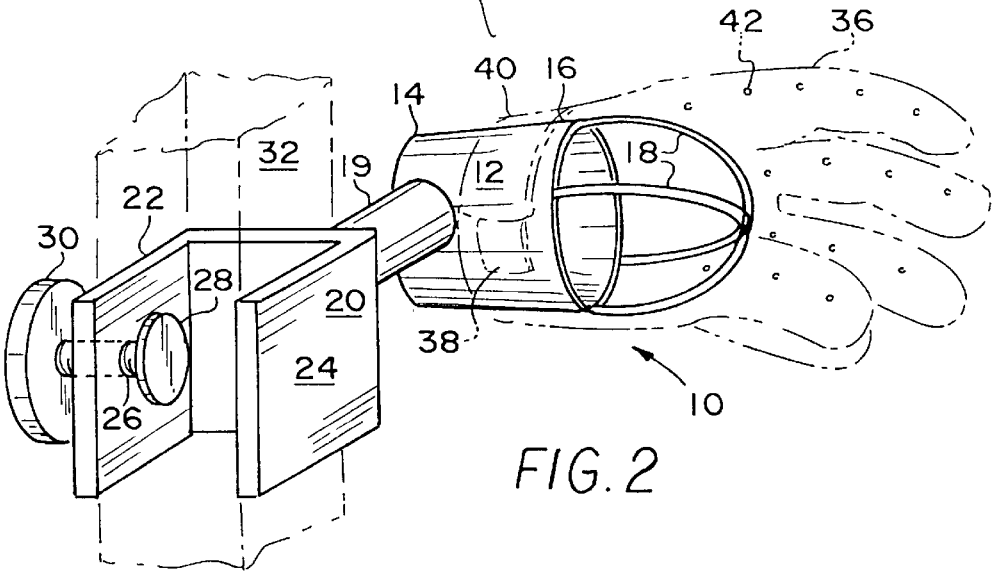
FIG. 2 is a perspective detail view of a first embodiment of a golf glove drying attachment for a golf cart or a golf bag according to the present invention.

Referring to FIG. 2, golf glove dryer 10 includes hollow shell 12. Hollow shell 12 is preferably oval shaped when viewed from one end, and has first open end 14 and second open end 16. Second open end 16 includes cross members 18. First end 14 attaches to clamp 20 by means of shaft 19, having opposing jaws 22,24. Opposing jaws 22,24 are perpendicular to the central axis of shell 12. Opposing jaw 22 includes threaded rod 26, attached to plate 28 and knob 30.

Figure 1:
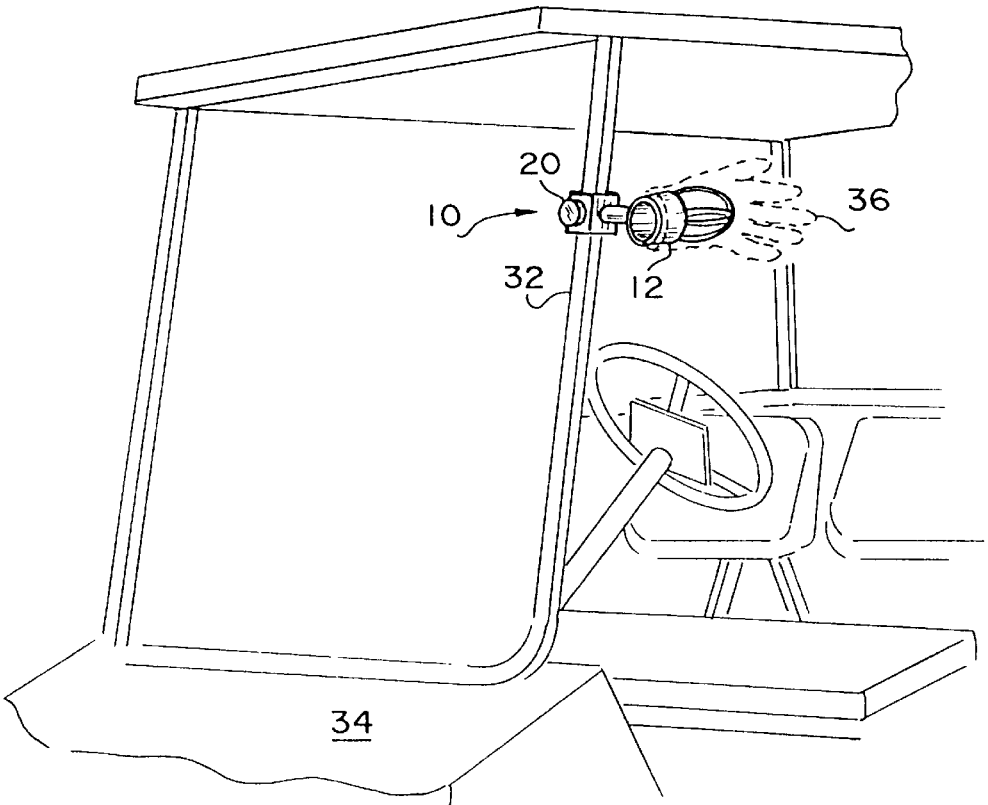
FIG. 1 is an environmental, perspective view of a first embodiment of a golf glove drying attachment for a golf cart or a golf bag according to the present invention.

Referring to FIGS. 1 and 2, to use the golf glove dryer 10, jaws 22,24 are positioned around golf cart roof support 32, and knob 30 is tightened, securing roof support 32 between plate 28 and jaw 24. Because shell 12 is perpendicular to jaws 22,24, shell 24 is horizontal. Preferably, first end 14 is oriented towards the front of golf cart 34. Glove 36, shown in phantom, is positioned over second end 16. Hook and loop wrist fastener 38, also shown in phantom, is closed, securing wrist portion 40 of glove 36 to shell 12. Cross members 18 hold the glove 36 open, allowing air flow through hollow shell 12 into glove 36. The wrist portion 40 is now oriented towards the front of golf cart 34. Driving the golf cart will cause air flow through shell 12, into glove 36, and out glove ventilation holes 42, thereby increasing the amount of air available to absorb evaporated sweat, and speeding the drying process.

Figure 3:
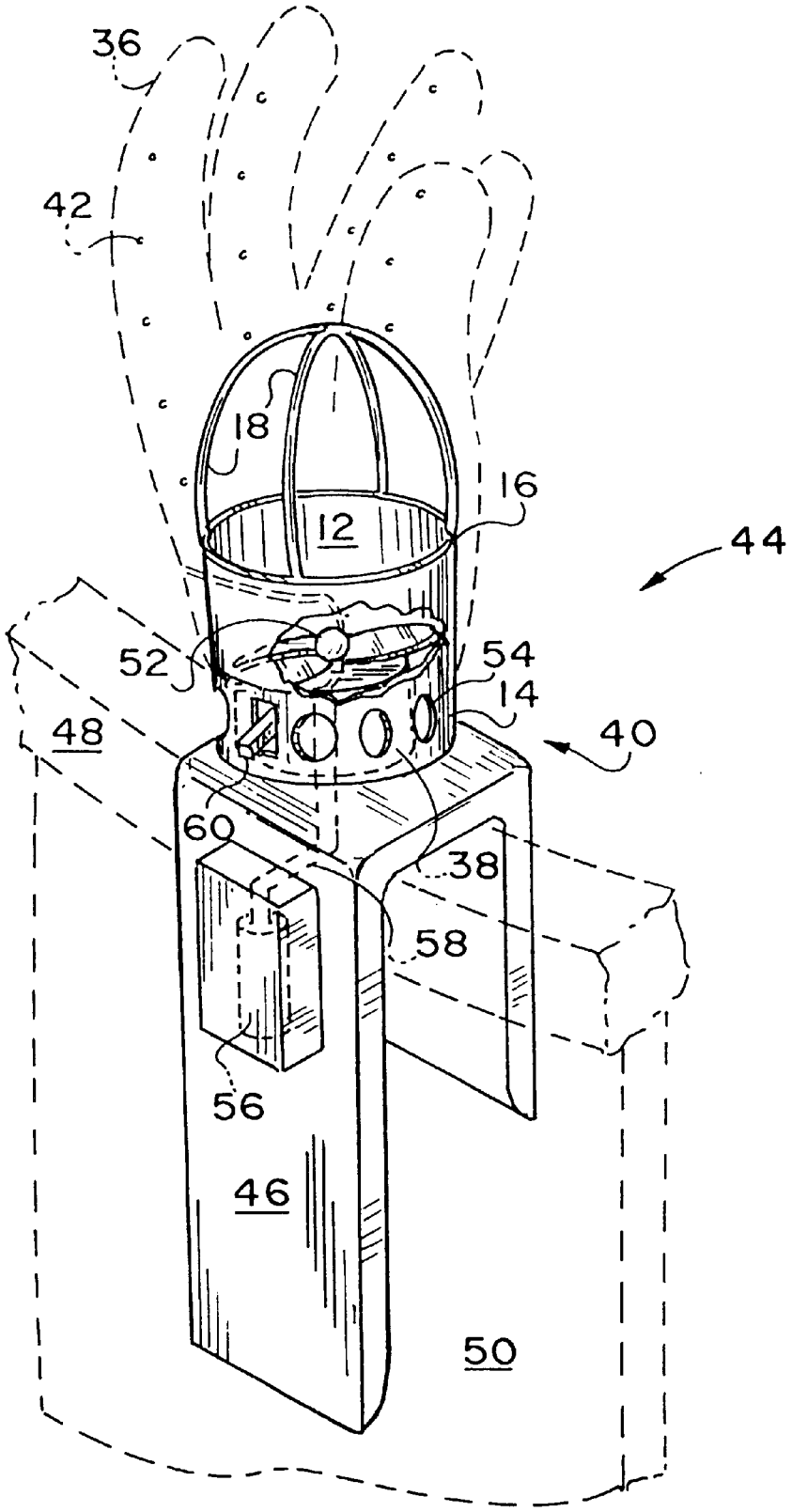
FIG. 3 is an environmental, perspective view of a second embodiment of a golf glove drying attachment for a golf cart or a golf bag according to the present invention.

Referring to FIG. 3, a second embodiment of the golf club dryer is shown. Golf glove dryer 44 includes hollow shell 12. Hollow shell 12 is preferably oval shaped when viewed from one end, and has first end 14 and second open end 16. Second open end 16 includes cross members 18. First end 14 attaches to clip 46, which will fit around the top lip 48 of golf bag 50. Fan 52 is located within first end 14, and first end 14 also includes air intake holes 54. Fan 52 is powered by batteries 56, located on the outside of clip 46, and connected to fan 52 by wires 58. Switch 60, located along one wire 58, activates the fan 52.

To use glove dryer 44, clip 46 is positioned over the top lip 48 of golf bag 50. Glove 36, shown in phantom, is positioned over second end 16. Hook and loop wrist fastener 38, also shown in phantom, is closed, securing wrist portion 40 of glove 36 to shell 12. Cross members 18 hold the glove 36 open, allowing air flow through hollow shell 12 into glove 36. Fan 52 is activated using switch 60, causing air flow into air intake holes 54, through hollow shell 12 and glove 36, and out ventilation holes 42, thereby increasing the amount of air available to absorb evaporated sweat, and speeding the drying process.

It is to be understood that the present invention is not limited to the embodiments described above, but encompasses any and all embodiments within the scope of the following claims.

I claim:

1. A golf glove drying attachment for drying a golf glove and attaching to a golf cart, the golf cart having a front, the glove having wrist portion and a hand portion, the golf cart having at least one roof support beam, said golf glove drying attachment comprising:

a tapered hollow shell defining an oval-shaped open first end and an oval-shaped open second end, said open second end having a cross section larger than that of said open first end, said hollow shell being dimensioned and configured to fit within the wrist portion of the glove;

convex cross members extending from said second end for retaining the glove in an opened configuration; and means for securing said hollow shell to a golf cart with said first end oriented towards the front of the golf cart.

2. The golf glove drying attachment according to claim 1, wherein said means for securing said hollow shell to a golf cart is a clamp on said first end.

3. The golf glove drying attachment according to claim 2, wherein said clamp is dimensioned and configured to clamp to the roof support beam of the golf cart.

4. The golf glove drying attachment according to claim wherein:

said clamp further comprises a pair of jaws; and said hollow shell is perpendicular to said jaws.

5. A golf glove drying attachment for drying a golf glove and attaching to a golf bag, the glove having wrist portion and a hand portion, the golf bag having a top lip, said golf glove drying attachment comprising:

a tapered hollow shell defining an oval-shaped first end and an oval-shaped open second end, said open second end having a cross section larder than that of said open first end, said hollow shell being dimensioned and configured to fit within the wrist portion of the glove, said first end having at least one air intake opening;

convex cross members extending from said second end for retaining the glove in an opened configuration;

means for securing said hollow shell to a golf bag; and a fan disposed within said first end.

6. The golf glove drying attachment according to claim 5, wherein said means for securing said hollow shell to a golf bag is a clip on said first end.

7. The golf glove drying attachment according to claim 6, wherein said clip is dimensioned and configured to clip to the top lip of a golf bag.

8. The golf glove drying attachment according to claim 5, wherein said fan is battery powered.

* * * * *